US008932084B2

(12) United States Patent
Thackston et al.

(10) Patent No.: US 8,932,084 B2
(45) Date of Patent: Jan. 13, 2015

(54) CONNECTOR SYSTEM

(71) Applicant: Tyco Electronics Corporation, Berwyn, PA (US)

(72) Inventors: Kevin Michael Thackston, York, PA (US); Albert Tsang, Harrisburg, PA (US); Robert Neil Mulfinger, York Haven, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 71 days.

(21) Appl. No.: 13/750,715

(22) Filed: Jan. 25, 2013

(65) Prior Publication Data

US 2014/0213119 A1 Jul. 31, 2014

(51) Int. Cl.

| | |
|---|---|
| ***H01R 24/00*** | (2011.01) |
| ***H01R 13/46*** | (2006.01) |
| ***H01R 13/52*** | (2006.01) |
| ***H01R 24/62*** | (2011.01) |
| *H01R 13/627* | (2006.01) |
| *H01R 13/633* | (2006.01) |
| *H01R 43/00* | (2006.01) |
| *H01R 107/00* | (2006.01) |

(52) U.S. Cl.

CPC ..... *H01R 13/46* (2013.01); *H01R 13/5227* (2013.01); *H01R 24/62* (2013.01); *H01R 13/5219* (2013.01); *H01R 13/6275* (2013.01); *H01R 13/633* (2013.01); *H01R 43/002* (2013.01); *H01R 2107/00* (2013.01)

USPC ..... 439/676

(58) Field of Classification Search

USPC ..... 439/676, 593, 787, 668–669, 76.1, 946

See application file for complete search history.

(56) References Cited

U.S. PATENT DOCUMENTS

| | | | | | |
|---|---|---|---|---|---|
| 2,396,725 | A | * | 3/1946 | Thomas, Jr. | 439/590 |
| 3,368,181 | A | | 2/1968 | Gimpel | |
| 3,626,356 | A | * | 12/1971 | Trammell | 439/205 |
| 4,647,128 | A | * | 3/1987 | Maros | 439/350 |
| 4,767,360 | A | * | 8/1988 | Bonhomme | 439/593 |
| 5,282,259 | A | * | 1/1994 | Grois et al. | 385/84 |
| 6,042,421 | A | * | 3/2000 | Stafford Gray et al. | 439/578 |
| 6,454,611 | B1 | * | 9/2002 | Francis | 439/676 |
| 8,100,726 | B2 | * | 1/2012 | Harlan et al. | 439/669 |

FOREIGN PATENT DOCUMENTS

WO WO 2006/026439 A2 3/2006

OTHER PUBLICATIONS

International Search Report, International Application No. PCT/US2014/011201, International Filing Date, Jan. 13, 2014.

* cited by examiner

*Primary Examiner* — Jean F Duverne

(57) ABSTRACT

A connector system includes a pass-through connector that includes a housing with a front and a rear opposite the front. The front of the housing has a front opening, and the rear of the housing has a rear opening. The housing also has a cavity between the front opening and the rear opening. The pass-through connector also includes conductors which are held by the housing in the cavity. The system also includes a plug that is received in the cavity through the front opening. The plug has a contact holder that holds plug conductors. The contact holder has a head that is received in the cavity, and the head is configured to push contaminants from the cavity through the rear opening as the plug is loaded into the cavity.

20 Claims, 5 Drawing Sheets

CONNECTOR SYSTEM

BACKGROUND OF THE INVENTION

The subject matter herein relates generally to a connector system.

Connectors are commonly used to interconnect electrical components together. For example, connectors are sometimes used to communicatively couple two printed circuits (sometimes referred to as "circuit boards") together. To interconnect the printed circuits, a connector of one of the components is mated with a connector of the other component. Other systems use a connector to connect a cable to a printed circuit or to another connector at an end of another cable. As the connectors are mated together, the connectors communicate with each other. Connectors may communicate with each other by mechanical connection through electrical contacts, mechanical connection using fiber optics, wireless signal transmission, and the like.

The connectors typically include a plug and a receptacle. The plug and receptacle connectors hold the conductors in housings. The receptacle connectors have a housing that is open only at the mating interface between the two connectors. Known connectors are not without problems. For example, in some environments, such as when the connectors are being used outside or in other harsh environments, contaminants like dirt, mud, grease, and sand, and fluids like water and oil may get trapped within the receptor connector. Contaminants may enter the opening to the receptacle connector while the receptacle connector is disconnected from the plug connector, or while the connectors are mated if the mating interface is not sealed. Contaminants within housings can contaminate the conductor surface between conductors, at the least interrupting the connection and potentially permanently damaging the connectors themselves. Removal of the contaminants is difficult and time consuming. Tools used to remove the contaminants may damage the conductors. Some contaminants may be permanently trapped beneath the conductors.

A need remains for a connector system that allows contaminants to be easily removed from the connectors.

BRIEF DESCRIPTION OF THE INVENTION

In one embodiment, a connector system is provided that includes a pass-through connector that includes a housing with a front and a rear opposite the front. The front has a front opening, and the rear has a rear opening. The housing has a cavity between the front opening and the rear opening. The pass-through connector also includes conductors that are held by the housing in the cavity. The system also includes a plug that is received in the cavity through the front opening. The plug has a contact holder that holds plug conductors. The contact holder has a head that is received in the cavity, and the head is configured to push contaminants from the cavity through the rear opening as the plug is loaded into the cavity.

In another embodiment, a connector system is provided that includes a pass-through connector that includes a housing with a front and a rear opposite the front. The front has a front opening and the rear has a rear opening. The housing has a cavity between the front opening and the rear opening, and the cavity is defined by cavity walls. The pass-through connector also includes conductors that are held by the housing in the cavity. The system also includes a plug that is received in the cavity through the front opening. The plug has a contact holder that holds plug conductors. The contact holder has a head that is received in the cavity, and the head has a wiping surface that engages the cavity walls. The head is configured to wipe along the walls and push contaminants from the cavity through the rear opening as the plug is loaded into the cavity.

DETAILED DESCRIPTION OF THE INVENTION

Figure 1:
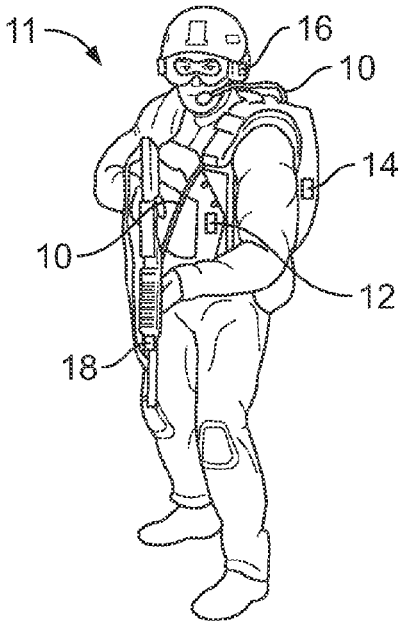
FIG. 1 illustrates a connector system formed in accordance with an exemplary embodiment and used to electrically connect various equipment carried by a user, such as a military soldier.

FIG. 1 illustrates a connector system 10 formed in accordance with an exemplary embodiment and used to electrically connect various equipment carried by a user 11, such as a military soldier. The connector system 10 provides the user 11 with releasable connections between the equipment that is configured to withstand exposure to contaminants such as dirt, mud, and sand. In an exemplary embodiment, the connector system 10 uses pass through connectors that allow contaminants to be easily cleared from the connectors.

The connector system 10 may include e-textiles or fabrics that enable computing, digital components and/or electronics to be embedded therein. The e-textiles may be incorporated into wearable articles, such as vests, shirts, pants, backpacks, and the like, that incorporate built-in technological elements into the fabric of the garment, in pockets of the garment or attached to the inside or outside of the garment.

The connector system 10 is used to interconnect various electronic devices, such as a first electronic device 12, a second electronic device 14, a third electronic device 16 and a fourth electronic device 18. Any number of electronic devices may be utilized in the connector system 10. In an exemplary embodiment, the first electronic device 12 constitutes a battery pack held in a pocket of a vest worn by the user 11. The second electronic device 14 constitutes a radio held in a backpack worn by the user 11. The third electronic device 16 constitutes a headset in a helmet worn by the user 11. The fourth electronic device 18 constitutes a light attached to a gun held by the user 11. The first electronic device 12 is electrically connected to the other electronic devices 14, 16, 18 via cables and connectors of the connector system 10, such as to power the electronic devices 14, 16, 18. The second and third electronic devices 14, 16 are electrically connected via cables and connectors of the connector system 10, such as to send data signals therebetween for communication between the headset and the radio.

The above electronic devices are merely examples of electronic devices that may be interconnected by the connector system 10. Other types of devices may be used in alternative embodiments depending on the user's needs, such as a computer, video recorder, personal radio, loop antenna, heating element, display screen, input device, sensor, induction loop or other components known to the industry. In addition to military applications, the connector system 10 may be used by other types of users such as in first responder applications, police applications, firefighting applications, automotive applications, industrial applications, commercial applications, and the like.

Figure 2:
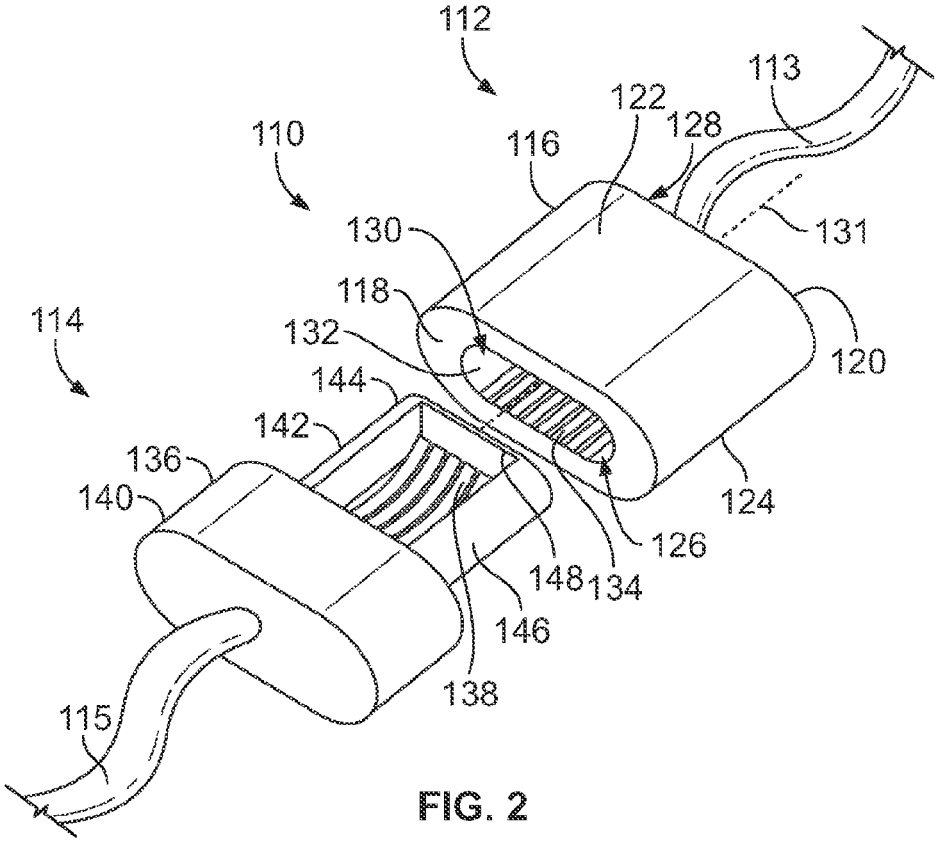
FIG. 2 is a perspective view of a connector system formed in accordance with an exemplary embodiment.

FIG. 2 is a perspective view of a connector system 110 formed in accordance with an exemplary embodiment. The connector system 110 may be used in place of the connector system 10 (shown in FIG. 1). The connector system 110 includes a pass-through (PT) connector 112 and a plug 114. The plug 114 is illustrated poised for mating with the PT connector 112. The plug 114 is configured to be releasably connected, or mated, to the PT connector 112, establishing a communication connection therebetween. In the illustrated embodiment, the PT connector 112 is terminated to an end of a cable 113 and the plug 114 is terminated to an end of a cable 115. Power and or data signals may be transmitted along the cables 113, 115 and through the PT connector 112 and plug 114 when mated. While the PT connector 112 and plug 114 are illustrated as being terminated to cables 113, 115, the PT connector 112 and/or the plug 114 may be terminated to other components, such as directly to a printed circuit board (PCB), a flex circuit, within another structure such as a helmet, an e-textile, a gun and the like with conductors, such as wires, contacts and the like terminated thereto.

The PT connector 112 includes a housing 116 having a front 118, a rear 120, a top 122, and a bottom 124. The housing 116 may have any shape, such as rectangular, cylindrical, spherical, or spheroidal shapes, for example. The housing 116 may have any size and shape depending on the type of electronic device (e.g. backpack, vest, helmet, glove, gun, pants, shirt, accessory and the like) that incorporates the PT connector 112. The housing 116 also includes a front opening 126 and a rear opening 128, with a cavity 130 extending between the front and rear openings 126, 128. The cavity 130 extends along a mating axis 131 between the front 118 and the rear 120. The plug 114 is configured to be loaded into the cavity 130 along the mating axis 131. The cavity 130 is defined by cavity walls along an interior surface 132 of the housing 116.

The cavity 130 is open at the front and rear openings 126, 128 to define a pass-through connector. The cavity 130 allows the plug 114 to pass through the PT connector 112. Having the cavity 130 open at the rear 120 allows contaminants to pass through and be ejected from the PT connector 112. For example, as the plug 114 is loaded into the cavity 130, the contaminants may be pushed out of the cavity 130. Such an arrangement allows the PT connector 112 to be quickly and easily cleaned. The cleaning occurs as the plug 114 is loaded into the PT connector 112. The cleaning is performed by the plug 114 without the need for other devices to remove the contaminants.

Conductors 134 are held within the cavity 130. The conductors 134 may be copper terminal conductors, fiber optic conductors, or wireless conductors, such as waveguides, depending on available connection methods. In the illustrated embodiment, the conductors 134 are illustrated as terminals and the conductors 134 may be referred to hereinafter as terminals 134, realizing that other types of conductors may be used in place of the terminals 134. The terminals 134 may be disposed along the interior surface 132 of the cavity 132. Optionally, the terminals 134 may be spring terminals configured to be deflected relative to the interior surface 132 during mating with the plug 114. The terminals 134 may be electrically connected to another electronic component, such as a printed circuit board (PCB), a flex circuit, wires, and the like for transmitting electrical signals. The terminals 134 may be oriented in a direction parallel to and along the mating axis 131 between the front and rear openings 126, 128. The terminals 134 may have other orientations, such as being perpendicular to the mating axis 131 or at another angle thereto. Optionally, the terminals 134 may be part of a flex circuit that wraps and extends at least partially around the interior surface 132 of the cavity 130 with the terminals 134 being exposed circuits of the flex circuit or being terminated to circuits of the flex circuit. The PT connector 112 may terminate to a wire, a cable, a flex circuit, a PCB, or another type of electrical transmission device.

The plug 114 includes a contact holder 136 that houses plug conductors 138 which physically interact with the conductors 134 when the plug 114 is loaded into the PT connector 112. Optionally, the conductors 138 may be copper contacts, fiber optic conductors, or wireless conductors, such as waveguides, depending on available connection methods. In the illustrated embodiment, the plug conductors 138 are illustrated as plug contacts and the conductors 138 may be referred to hereinafter as contacts or plug contacts 134, realizing that other types of conductors may be used in place of the contacts 134. The plug 114 may be any size and shape that allows the plug contacts 138 to be loaded into the PT connector 112 and make contact with the terminals 134. The contact holder 136 features a body 140 and a head 142, with the head 142 extending from the body 140. The head 142 holds the plug contacts 138. Optionally, the body 140 may hold portions of the plug contacts 138 as well. For example, terminating ends of the plug contacts 138, which are configured to be terminated to other electrical components such as wires, cables, a PCB, a flex circuit, or other types of conductors, may be terminated within the body 140. As shown in FIG. 2, the body 140 may optionally have the same shape as the housing 116 of the PT connector 112.

In an exemplary embodiment, the head 142 is defined by a frame 144 which includes side frames 146 and a front cross beam 148 spanning the side frames 146 at a distal end from the body 140. The plug contacts 138 are affixed to both the plug body 140 and the front cross beam 148 and span across the length of the frame 144. Optionally, the head 142 and body 140 may be molded over the plug contacts 138. For example, the plug contacts 138 may be part of a lead frame that is overmolded with plastic material or another material to form the head 142 and the body 140. Alternatively, the plug contacts 138 may be loaded or stitched into the body 140 and/or the head 142 during an assembly process.

In the illustrated embodiment, the frame 144 is open between the side frames 146 both above and below the plug contacts 138. The open configuration reduces available areas for debris accumulation and allows for cleaning underneath the plug contacts 138. In alternative embodiments, a backing material or contact support may be provided under the contacts 138. For example, a rubber overmold may be used for sealing the backside of the contacts 138 from exposure to debris.

The plug contacts 138 and connector terminals 134 are formed of electrically conductive materials as well known in the art. In an exemplary embodiment, the plug contacts 138 and/or the terminals 134 are spring-type contacts configured to be deflected or bowed when mated to apply a spring force therebetween when the plug 114 and PT connector 112 are mated. Other types of contacts may be used in alternative embodiments, such as pin contacts, socket contacts, blade contacts, pad contacts, and the like.

The plug head 142 is dimensionally configured to be received in the cavity 130 of the PT connector 112 through the front opening 126. During mating, the front cross beam 148 enters the cavity 130 first upon loading the plug 114 into the PT connector 112. Optionally, the front opening 126 and the cavity 130 may be dimensionally only slightly larger than the head 142, such that upon loading, the front cross beam 148 and/or the side frames 146 wipe against the terminals 134 and/or the interior surface 132 of the cavity 130. The wiping function clears contaminants such as debris, moisture and the like from the cavity 130 and from the terminals 134. The head 142 along the surfaces of the front cross beam 148 and/or the side frames 146 may include a non-marring material that is slightly deformable so as to allow a snug fit along the interior surfaces 132 of the cavity 130 without damaging or scratching the terminals 134 upon loading and unloading. Moreover, the non-marring material may be resilient enough to expel dirt, mud, and other contaminants that may be housed in the cavity 130. For example, the non-marring material may be rubber or a rubber-like material.

Figure 3:
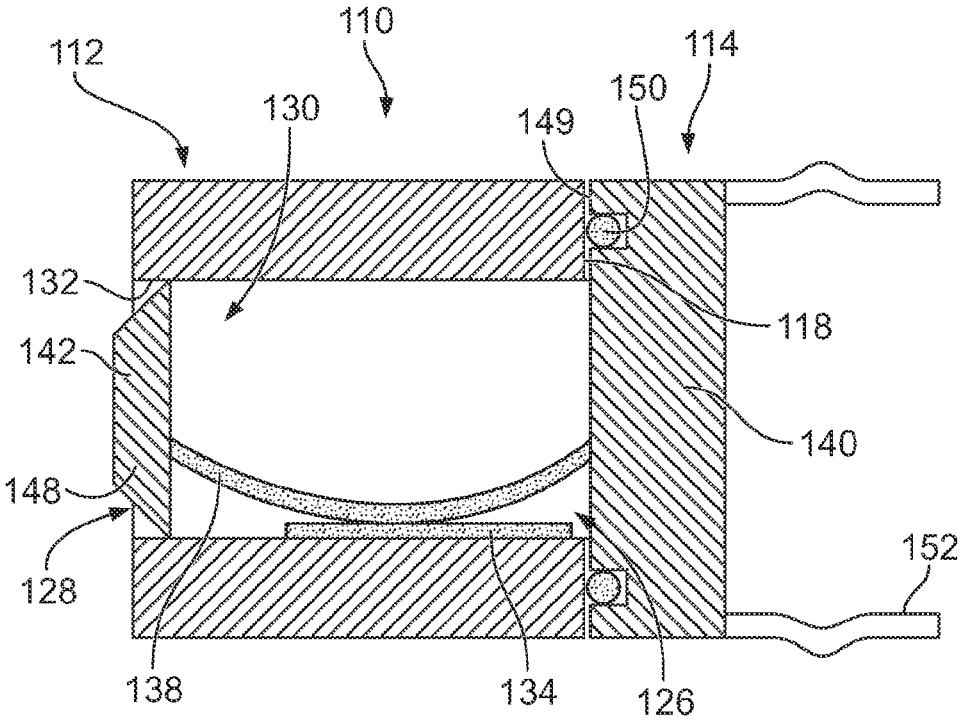
FIG. 3 is a cross-sectional view of the connector system shown in FIG. 2.

FIG. 3 is a cross-sectional view of the connector system 110 illustrating the PT connector 112 and plug 114 in a mated position. During mating, the head 142 is inserted, with the front cross beam 148 first, through the front opening 126 and into the cavity 130. The plug contacts 138 are bowed or deflected as they mate to corresponding terminals 134 as the plug 114 loads into the cavity 130. When the plug contacts 138 are in a flex orientation, a spring force is applied against the terminals 134 to keep a connection therebetween.

In an exemplary embodiment, the head 142 of the plug 114 extends through the cavity 130 until the body 140 contacts the front 118 of the PT connector 112. As shown in FIG. 3, the distal end of the head 142 extends into the cavity 130 beyond the terminals 134 such that the plug contacts 138 may electrically contact the terminals 134. As the plug 114 is loaded, contaminants in the cavity 130 are pushed beyond the terminals 134 towards the rear opening 128 of the PT connector 112. The distal end of the head 142 may optionally be recessed from the rear opening 128 when the plug 114 is fully loaded. Alternatively, the distal end of the head 142 may extend up to and flush with the rear opening 128 of the PT connector 112 or past the rear opening 128, such that contaminants in the cavity 130 may be ejected therefrom by the plug 114. The clearance between the interior surfaces 132 of the cavity 130 and the head 142 is slight so as to create a wiping action as the plug 114 is loaded into the PT connector 112, pushing debris past the terminals 134 and, to some extent, expelling them through the rear opening 128. Optionally, the plug 114 may be held in the cavity 130 by a friction or interference fit. Alternatively, latches or other features may be provided that secure the plug 114 to the PT connector 112.

At an interface 149 between the body 140 of the plug 114 and the front 118 of the PT connector 112, a compression seal 150 may be provided. The seal 150 may be held by the body 140, or alternatively may be held by the PT connector 112, and extend circumferentially at or near the periphery of the front 118 of the PT connector 112. The seal 150 may be an O-ring or gasket. The seal 150 may be manufactured from rubber or another compressible material. The seal 150 is configured to prevent contaminants from entering the cavity 130 while the plug 114 and the PT connector 112 are mated. The seal 150 creates a seal by forming a friction fit between the plug 114 and PT connector 112. Various other seals may be provided within the cavity 130 (e.g., wiping seals) or outside of the cavity 130 (e.g., peripheral seals) at the interfaces between the plug 114 and the PT connector 112 to prohibit the entry of contaminants into the cavity 130.

In an exemplary embodiment, the plug 114 includes mounting flanges 152 extending from the body 140 of the plug 114 in generally the opposite direction as the head 142. The mounting flanges 152 are configured to connect the plug 114 to another structure or component, such as a wire, cable, a PCB, an e-textile, a helmet, a backpack, a gun or another component held by the user. The mounting flanges 152 may be flexible, such as including a bend along the length thereof. The mounting flanges 152 provide a normal force for the compression seal 150 when mounted to the PT connector 112.

Figure 4:
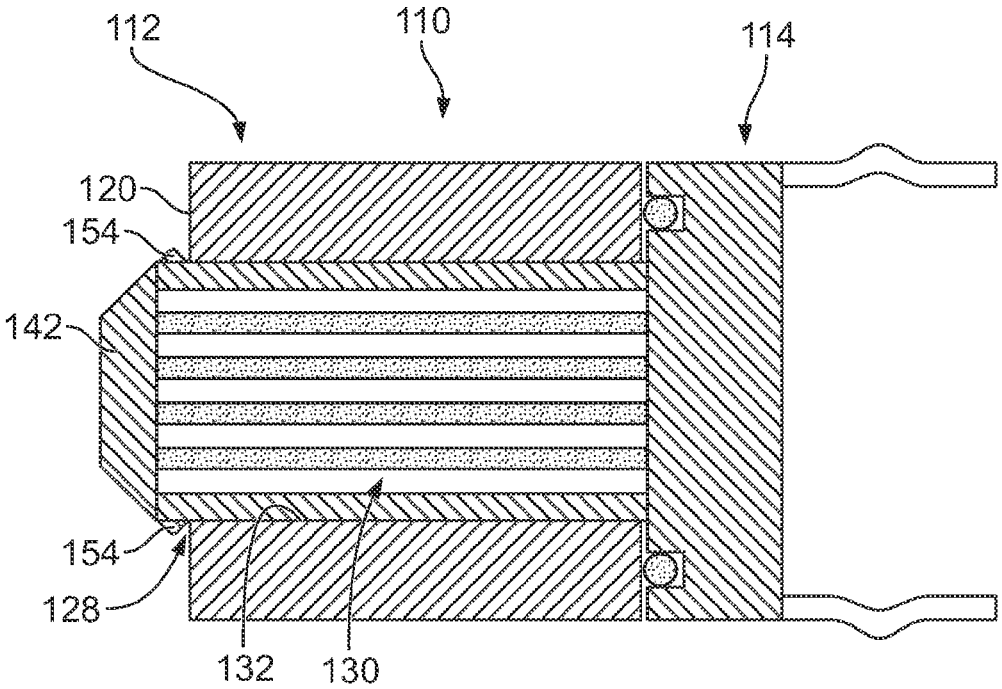
FIG. 4 is a top-down cross-sectional view of the connector system shown in FIG. 2.

FIG. 4 is a top-down cross-sectional view of the connector system 110, illustrating the PT connector 112 and the plug 114 in a mated position. In the illustrated embodiment, the head 142 of the plug 114 extends past the rear opening 128 of the PT connector 112 upon loading. In the illustrated embodiment, the head 142 includes at least one ear 154. The ears 154 are optionally located towards the distal end of the head 142. The ears 154 are configured to engage the rear 120 of the PT connector 112 when the PT connector 112 and plug 114 are mated. The ears 154 generally provide holding forces, such as friction, elastic, or normal, that oppose the separation of the plug 114 from the PT connector 112 to resist unintentional separation of the plug 114 from the PT connector 112. The ears 154 may provide a normal force for the peripheral compression seal 150. Optionally, the holding force provided by the ears 154 may be overcome by applying a high enough pulling force on the plug 114 or the PT connector 112 to allow unmating.

The ears 154 of the plug 114 may be composed of a non-marring compressible material, such as rubber, to allow compression through the cavity 130 of the PT connector 112 during loading. Alternatively, springs may connect the ears 154 to the head 142 to provide deflection of the ears 154 through the cavity 130. The ears 154 may wipe along the interior surfaces 132 as the plug 114 is loaded into the PF connector 112 to remove contaminants and/or clean the interior surfaces 132. The ears 154 may decompress after passing through the rear opening 128 of the PT connector 112, which enlarges the dimension of the head 142 beyond the dimension of the rear opening 128. In one embodiment, the ears 154 may be configured as a continuous ridge disposed around the perimeter of the head 142 that engages the rear 120 of the PT connector 112 along the perimeter of the PT connector 112 to provide both a latching function and a peripheral seal along the rear opening 128 of the PT connector 112.

Alternatively, the ears 154 may be located along a portion of the head 142 that does not extend past the rear opening 128, whereas the ears 154 engage the interior surface 132 of the cavity 130. The ears 154 may be loaded into channels in the cavity 130 to provide an interference connection to hold the plug 114 in the PT connector 112. The ears 154 may stay compressed within the cavity 130, providing elastic and frictional forces against the interior surfaces 132 of the cavity 130.

Figure 5:
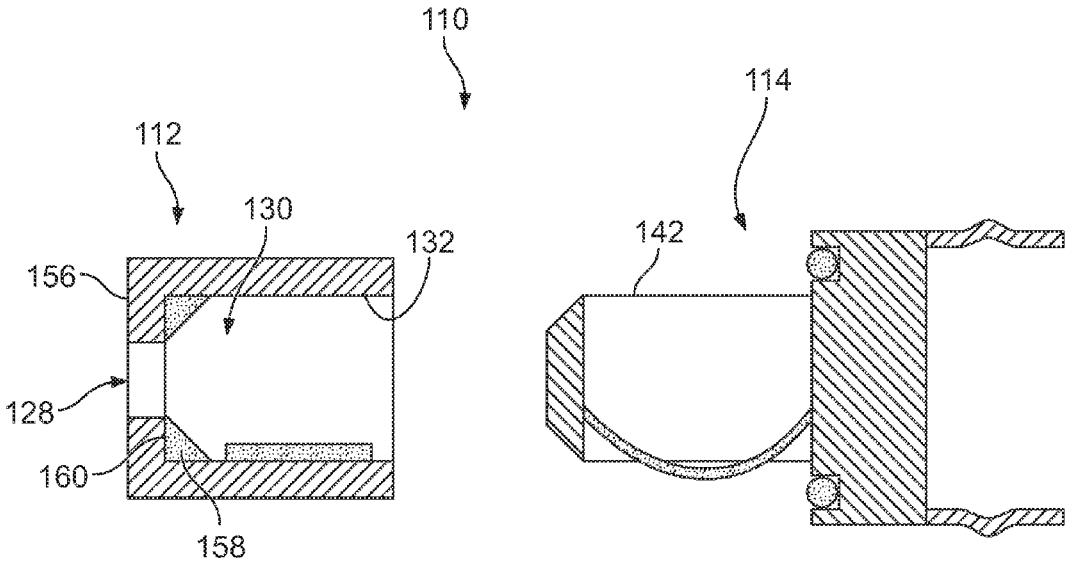
FIG. 5 is a cross-sectional view of the connector system shown in FIG. 2.

FIG. 5 is a cross-sectional view of the connector system 110, illustrating the PT connector 112 and the plug 114 poised for mating. In the illustrated embodiment, the PT connector 112 includes a rear wall 156. The rear opening 128 of the PT connector 112 extends through the rear wall 156. The rear opening 128 is dimensionally smaller than at least a portion of the cavity 130. A compression seal 158 may be provided at an interface 160 between the rear wall 156 and the interior surface 132 of the cavity 130. The compression seal 158 may be a wiping seal angled to direct debris or other contaminants out of the cavity 130 toward the rear opening 128 upon loading the plug 114 into the cavity 130. Alternatively, the seal 158 may be held by the head 142 of the plug 114 rather than the PT connector 112. The seal 158 may be an O-ring or gasket, and may be manufactured from rubber or another compressible material. The seal 158 may optionally be angled to correspond with the orientation of the interface 160 to increase the surface area of the seal 158. The seal 158 is configured to prevent contaminants from entering the cavity 130 through the rear opening 128 while the plug 114 and the PT connector 112 are mated.

Although the PT connector 112 includes a rear wall 156, the head 142 of the plug 114 may still extend up to or through the rear opening 128 defined by the rear wall 156 upon loading. Optionally, the interface 160 may slope from the cavity 130 to the rear opening 128, providing a path for fluids and debris within the PT connector 112 to be expelled by the plug 114 through the rear opening 128.

Figure 6:
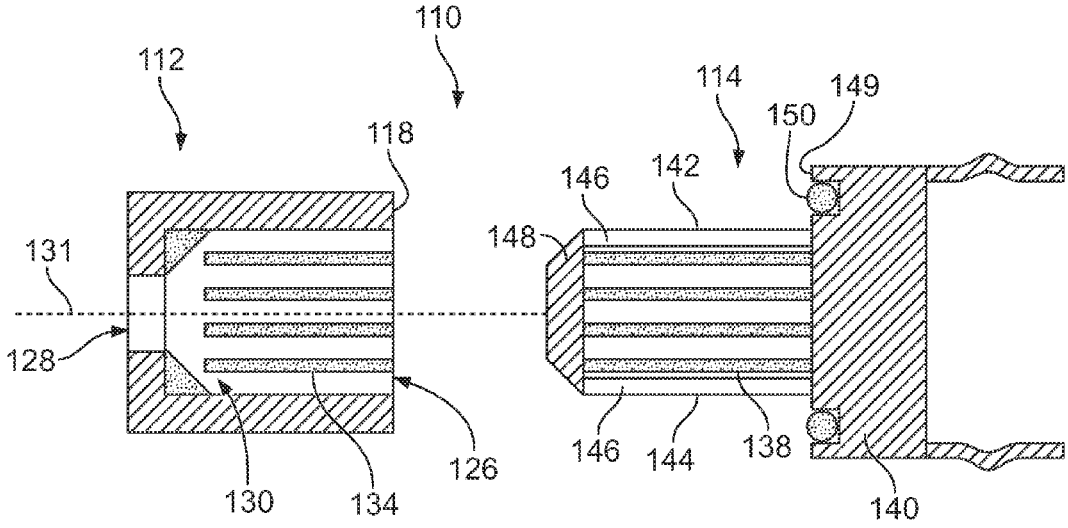
FIG. 6 is a top-down cross-sectional view of the connector system shown in FIG. 5.

FIG. 6 is a top-down cross-sectional view of the connector system 110 illustrated in FIG. 5. The connector system 110 includes the PT connector 112 and the plug 114, which are illustrated poised for mating. The terminals 134 of the PT connector 112 are located at least partially within the cavity 130 and are oriented in a direction parallel to and along the mating axis 131 between the front and rear openings 126, 128. The head 142 is defined by a frame 144 which includes side frames 146 and a front cross beam 148 spanning the side frames 146 at a distal end from the body 140. The plug contacts 138 are affixed to both the plug body 140 and the front cross beam 148 and span across the length of the frame 144. Each of the plug contacts 138 is configured to align with and contact a respective individual terminal 134 upon mating the plug 114 to the PT connector 112.

The compression seal 150 at the interface 149 between the body 140 of the plug 114 and the front 118 of the PT connector 112 prohibits contaminants from entering the cavity 130 through the front opening when the plug 114 and PT connector 112 are mated.

Figure 7:
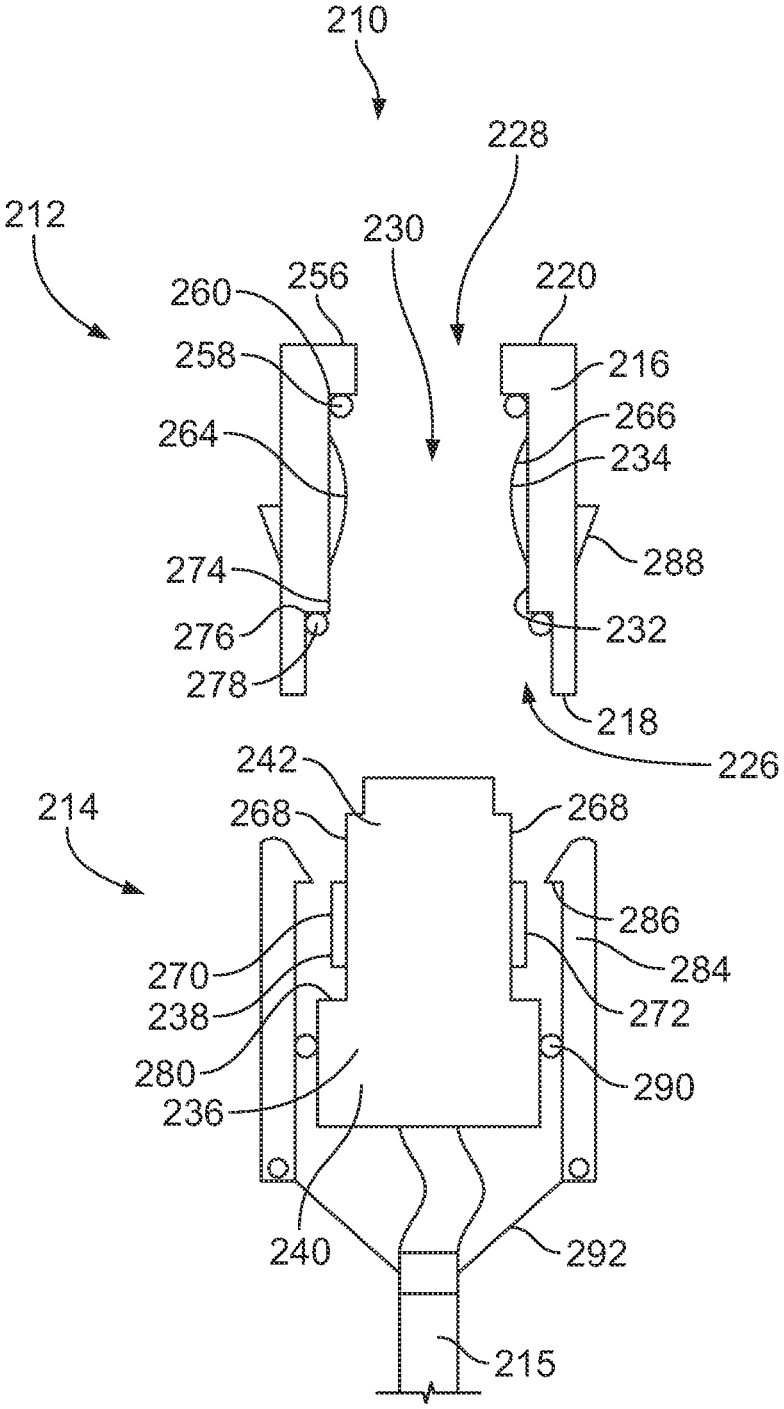
FIG. 7 is a cross-sectional view of a connector system formed in accordance with an exemplary embodiment.

FIG. 7 is a cross-sectional view of a connector system 210 formed in accordance with an exemplary embodiment. The connector system 210 may be similar to the connector system 110 (shown in FIGS. 2-6) in some respects. The connector system 210 includes a pass-through (PT) connector 212 and a plug 214. The plug 214 is illustrated poised for mating with the PT connector 212.

The PT connector 212 includes a housing 216 having a front 218, a rear 220, a front opening 226 and a rear opening 228, with a cavity 230 extending between the front and rear openings 226, 228, being defined by cavity walls along an interior surface 232 of the housing 216. Terminals 234 are held within the cavity 230 along the interior surface 232. In an exemplary embodiment, the terminals 234 are held in two different rows on opposite sides of the cavity 230 defining a first terminal group 264 and a second terminal group 266. The first and second terminal groups 264, 266 may be diametrically opposed along the interior surface 232 of the cavity 230 and oriented in a spaced parallel relation to each other. The terminals 234 may be spring terminals configured to be deflected relative to the interior surface 232 during mating with the plug 214.

The plug 214 includes a contact holder 236 that houses plug contacts 238 and includes a body 240 and a head 242. The plug contacts 238 are optionally held along two opposite exterior surfaces 268 of the head 242. The plug contacts 238 may be separated into different groups including a first contact group 270 and a second contact group 272. The first and second contact groups 270, 272 are aligned for mating with respective first and second terminal groups 264, 266 of the PT connector 212 upon loading. As such, the first and second contact groups 270, 272 may be located along diametrically opposite portions of the exterior surface 268 of the head 242 in a parallel orientation to each other. The plug contacts 238 may be pad contacts which are relatively flat and deflect little relative to the exterior surface 268 of the head 242 during mating with the PT connector 212.

The plug head 242 is dimensionally configured to be received in the cavity 230 of the PT connector 212 through the front opening 226 during mating. Optionally, the cavity 230 may be dimensionally only slightly larger than the head 242, such that upon loading, the head 242 wipes against the terminals 234 and/or the interior surface 232 of the cavity 230, removing contaminants in the process. The PT connector 212 may include a rear wall 256 defining the rear opening 228, with a compression seal 258 located at the interface 260 between the rear wall 256 and the interior surface 232 of the cavity 230. In addition, the PT connector 212 may also include an intermediate wall 274 defining an intermediate shoulder 276 between the terminals 234 and the front opening 226. A compression seal 278 may be located at the shoulder 276. The plug 214 includes a corresponding shoulder 280. Upon loading of the plug 214 into the cavity 230, the shoulder 280 of the plug 214 engages the seal 278 to seal the front opening 226 of the PT connector 212.

The plug 214 may include at least one latch 284 configured to releasably secure the plug 214 to the PT connector 212. The latches 284 may be released to disconnect the plug 214 from the PT connector 212. Each of the latches 284 includes a latching surface 286 configured to interact with a catch 288 located along the housing 216 of the PT connector 212. Other types of securing features may be used in alternative embodiments to secure the plug 214 to the PT connector 212.

The coupling of the latching surface 286 to the catch 288 provides a normal force for the compression seals 258, 278 and also prohibits unintentional disconnection of the plug 214 from the PT connector 212. Each latch 284 may be pivotably affixed to the body 240 of the plug 214 via a hinge 290. Each latch 284 may be released from the catch 288 by applying a directional force to the latch 284 either towards or away from the plug 214 based on the relation of the point of force application to the hinge 290 as is well-known in the art.

Optionally, the latch 284 may be released by pulling a release lanyard 292. In the illustrated embodiment, the release lanyard 292 connects the latch 284 to a power or data cable 215 to which the plug 214 terminates. The cable 215 has slack between the plug 214 and release lanyard 292 attachment point. Pulling the cable 215 provides tension in the release lanyard 292, pivoting the latch 284 along the hinge 290, which releases the latching surface 286 from the catch 288 and allows the plug 214 to disconnect from the PT connector 212.

Figure 8:
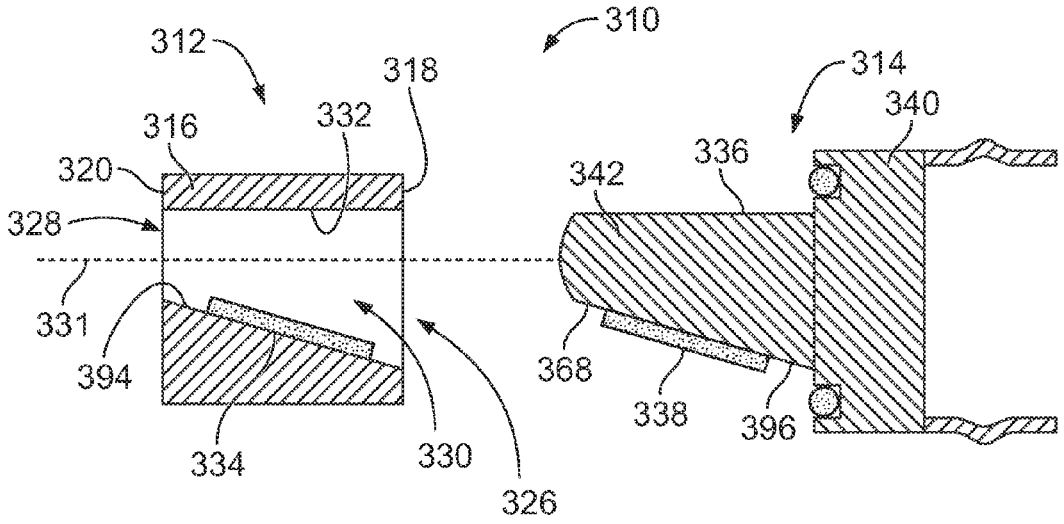
FIG. 8 is a cross-sectional view of a connector system formed in accordance with an exemplary embodiment.

FIG. 8 is a cross-sectional view of a connector system 310 formed in accordance with an exemplary embodiment. The connector system 310 may be similar to the connector systems 110, 210 (shown in FIGS. 2-7). The connector system 310 includes a pass-through (PT) connector 312 and a plug 314. The plug 314 is illustrated poised for mating with the PT connector 312.

The PT connector 312 includes a housing 316 having a front 318, a rear 320, a front opening 326 and a rear opening 328, with a cavity 330 extending between the front and rear openings 326, 328, being defined by cavity walls along an interior surface 332 of the housing 316. The rear opening 328 may be dimensionally smaller than the front opening 326, with the interior surface 332 including a slanted portion 394 relative to a mating axis 331 between the front and rear openings 326, 328. Terminals 334 are held within the cavity 330 along the slanted portion 394 of the interior surface 332.

The terminals 334 optionally may be pad terminals, as illustrated, with the slanted portion 394 acting as a backer support, which may be referred to hereinafter as 394. The backer support 394 supports the terminals 334 and prevents contaminants from being trapped between the terminals 334 and the interior surface 332. The backer support 394 may be a non-marring material such as rubber that would not scratch or damage the terminals 334. The backer support 394 may be partially compressible, such as when mated with the plug 314, to provide a biasing force to hold the terminals 334 in contact with the plug 314.

The plug 314 includes a contact holder 336 that houses plug contacts 338 and includes a body 340 and a head 342. The plug head 342 is configured to be received in the cavity 330 of the PT connector 312 through the front opening 326 during mating. Optionally, the cavity 330 may be dimensionally only slightly larger than the head 342 to allow a wiping function as the plug 314 is loaded into the cavity 330. The head 342 includes a slanted portion 396 that tapers in the distal direction away from the body 340, corresponding to the shape of the cavity 330. The plug contacts 338 may be located along an exterior surface 368 of the head 342 that faces the terminals 334 within the PT connector 312 when loaded. The plug contacts 338 optionally may be pad contacts. The slanted portion 396 defines a backer support, referred to hereinafter as 396, beneath the contacts 338 that both provides support to the contacts 338 and prevents contaminants from being trapped between the contacts 338 and the head 342. The backer support 396 may be a non-marring material such as rubber that would not scratch or damage the contacts 338. The backer support 396 may be partially compressible, such as when the plug 314 is mated in the PT connector 312, to provide a biasing force to hold the plug contacts 338 in contact with the terminals 334.

Upon loading of the plug 314 into the PT connector 312, the head 342 wipes against the terminals 334 and/or the interior surface 332 of the cavity 330. Optionally, the plug contacts 338 may wipe against the terminals 334 to scrape the metal surface layers thereof to remove contaminants or buildup on the surfaces thereof to ensure metal to metal contact when mated.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a pass-through connector comprising a housing having a front and a rear opposite the front, the front having a front opening, the rear having a rear opening, the housing having a cavity between the front opening and the rear opening, the pass-through connector comprising conductors held by the housing in the cavity; and a plug received in the cavity through the front opening, the plug having a contact holder holding plug conductors, the contact holder having a head received in the cavity, the head having a distal end that enters the cavity through the front opening as the plug is received in the cavity, the distal end of the head extending at least one of flush with or past the rear opening at the rear to push contaminants from the cavity through the rear opening.

2. The connector system of claim 1, wherein the head includes a wiping surface, the wiping surface engaging an interior surface of the cavity to wipe contaminants from the interior surface as the plug is loaded into the cavity.

3. The connector system of claim 1, wherein the head includes ears at the distal end of the head, the ears extending beyond the rear of the housing to latch the plug in the pass-through connector.

4. The connector system of claim 1, wherein the head includes a wiping surface comprising a non-marring material, the wiping surface wiping against at least one of cavity walls of the cavity and the conductors in the cavity as the plug is loaded into the cavity.

5. The connector system of claim 1, further comprising a compression seal proximate to the front opening to seal the front opening and a compression seal proximate to the rear opening to seal the rear opening.

6. The connector system of claim 1, wherein the plug includes a latch engaging an exterior of the housing, the latch securing the plug to the pass-through connector, the latch being releasable.

7. The connector system of claim 6, further comprising a cable coupled to the plug, the cable being electrically connected to the plug conductors, a lanyard extending between the cable and the latch, wherein rearward pulling on the cable actuates the lanyard and releases the latch.

8. The connector system of claim 1, wherein the head includes a frame having side frames and a front cross beam extending between the side frames, the frame extending from a body of the plug, the plug conductors held between the body and the cross beam, the frame being open between the side frames beneath the plug conductors.

9. The connector system of claim 1, wherein the head includes a backer support beneath the plug conductors, the backer support supporting the plug conductors to prevent contaminants from being trapped between the plug conductors and the head.

10. The connector system of claim 1, wherein the housing includes a rear wall, the rear opening extending through the rear wall, the rear opening being dimensionally smaller than the front opening, a compression seal being coupled to the rear wall interior of the cavity, the head engaging the compression seal.

11. The connector system of claim 1, wherein the pass-through connector comprises a flex circuit held by the housing, the flex circuit wrapping around the cavity, the conductors being electrically connected to the flex circuit.

12. The connector system of claim 1, wherein the cavity extends along a mating axis between the front and the rear of the pass-through connector, the front opening oriented in a first plane perpendicular to the mating axis and the rear opening oriented in a second plane perpendicular to the mating axis.

13. A connector system comprising:

a pass-through connector comprising a housing having a front and a rear opposite the front, the front having a front opening, the rear having a rear opening, the housing having a cavity extending along a mating axis between the front opening and the rear opening, the cavity being defined by cavity walls, the pass-through connector comprising conductors held by the housing in the cavity, the conductors oriented parallel to the mating axis; and a plug received in the cavity through the front opening in a direction along the mating axis, the plug having a contact holder holding plug conductors, the contact holder having a body and a head extending from the body, the plug conductors oriented longitudinally between the body and a distal end of the head, the head entering the cavity such that the plug conductors align with corresponding conductors of the pass-through connector, the plug conductors engaging and wiping against the corresponding conductors along a length of the conductors as the head moves toward the rear of the pass-through connector to remove contaminants from between the plug conductors and the conductors of the pass-through connector, the head having a wiping surface engaging the cavity walls and wiping along the walls and push contaminants from the cavity through the rear opening.

14. The connector system of claim 13, wherein the wiping surface comprises a non-marring material, the wiping surface wiping against the conductors in the cavity as the plug is loaded into the cavity.

15. The connector system of claim 13, wherein at least a portion of the head passes through the rear opening.

16. The connector system of claim 13, further comprising compression seals at an interface between the pass-through connector and the plug, the compression seals sealing the cavity.

17. The connector system of claim 13, wherein the housing includes a rear wall, the rear opening extending through the rear wall, the rear opening being dimensionally smaller than the front opening, a compression seal being coupled to the cavity wall along the rear wall, the head engaging the compression seal.

18. The connector system of claim 13, wherein the head includes a frame having side frames and a front cross beam extending between the side frames, the frame extending from the body of the plug, the plug conductors held between the body and the cross beam, the frame being open between the side frames beneath the plug conductors.

19. The connector system of claim 13, wherein the head includes a backer support beneath the plug conductors, the backer support supporting the plug conductors to prevent contaminants from being trapped beneath the plug conductors.

20. The connector system of claim 13, wherein at least one of the plug conductors of the plug or the conductors of the pass-through connector are deflectable spring contacts that deflect as the head of the plug is received within the cavity and the plug conductors engage the conductors of the pass-through connector, the spring contacts applying a biased spring force against the other of the plug conductors or the conductors of the pass-through connector to retain a mechanical connection therebetween as the plug conductors wipe against the corresponding conductors of the pass-through connector.

* * * * *